US007316125B2

(12) United States Patent
Uekado et al.

(10) Patent No.: US 7,316,125 B2
(45) Date of Patent: Jan. 8, 2008

(54) INSULATED BOX BODY, REFRIGERATOR HAVING THE BOX BODY, AND METHOD OF RECYCLING MATERIALS FOR INSULATED BOX BODY

(75) Inventors: Kazutaka Uekado, Hyogo (JP); Masato Sasaki, Shiga (JP); Akira Nakano, Kyoto (JP); Yoshiki Ohashi, Shiga (JP)

(73) Assignee: Matsushita Refrigeration Company, Shiga (JP)

( * ) Notice: Subject to any disclaimer, the term of this patent is extended or adjusted under 35 U.S.C. 154(b) by 148 days.

(21) Appl. No.: 10/479,208

(22) PCT Filed: May 31, 2002

(86) PCT No.: PCT/JP02/05398

§ 371 (c)(1),
(2), (4) Date: May 7, 2004

(87) PCT Pub. No.: WO02/099347

PCT Pub. Date: Dec. 12, 2002

(65) Prior Publication Data

US 2004/0174106 A1 Sep. 9, 2004

(30) Foreign Application Priority Data

Jun. 4, 2001 (JP) ..... 2001-167998

(51) Int. Cl.
*F25D 11/02* (2006.01)

(52) U.S. Cl. ..... 62/440; 312/404

(58) Field of Classification Search ..... 62/441, 62/440, 444, 447; 312/404
See application file for complete search history.

(56) References Cited

U.S. PATENT DOCUMENTS 4,668,555 A 5/1987 Uekado et al.

(Continued)

FOREIGN PATENT DOCUMENTS

EP 1 001 233 5/2000

(Continued)

OTHER PUBLICATIONS

International Preliminary Examination Report for Application No. PCT/JP02/05398, Jun. 17, 2003.

(Continued)

*Primary Examiner*—William E. Tapolcai
(74) *Attorney, Agent, or Firm*—RatnerPrestia

(57) ABSTRACT

An insulation box unit and a refrigerator of the present invention employs i) rigid urethane foam with a 8.0 MPa-or-greater bending modulus, and a 60 kg/m$^3$-or-lower density, and ii) a vacuum insulation material. The proper bending modulus provides the insulation box unit with a substantial strength, even in the case that the coverage of the vacuum insulation material with respect to the surface of the outer box exceeds 40%. The proper density prevents the insulation box unit from poor insulation efficiency due to undesired solid thermal conductivity. Despite of an extended use of the vacuum insulation material, the insulation box unit offers an excellent insulation efficiency and therefore accelerates energy saving. According to the recycling method of the present invention, rigid urethane foam formed of tolylene di-isocyanate composition, which was separated from refrigerator wastes, is recycled as a material of rigid urethane foam.

24 Claims, 8 Drawing Sheets

U.S. PATENT DOCUMENTS

| | | | | |
|---|---|---|---|---|
| 4,726,974 | A | 2/1988 | Nowobilski et al. | |
| 4,788,832 | A * | 12/1988 | Aoki et al. | 62/382 |
| 5,983,647 | A * | 11/1999 | Uekado et al. | 62/45.1 |
| 6,101,819 | A * | 8/2000 | Onaka et al. | 62/125 |
| 6,128,914 | A * | 10/2000 | Tamaoki et al. | 62/440 |
| 6,164,030 | A | 12/2000 | Dietrich et al. | |
| 6,355,700 | B1 * | 3/2002 | Uekado et al. | 521/107 |
| 6,660,779 | B2 * | 12/2003 | Uekado et al. | 521/49 |
| 6,802,997 | B2 * | 10/2004 | Uekado et al. | 264/45.1 |

FOREIGN PATENT DOCUMENTS

| | | | |
|---|---|---|---|
| JP | 57-96852 | | 6/1982 |
| JP | 63-187084 | | 8/1988 |
| JP | 05-157446 | | 10/1993 |
| JP | 7-77383 | A | 3/1995 |
| JP | 7-110097 | A | 4/1995 |
| JP | 8-68591 | A | 3/1996 |
| JP | 10-212332 | A | 8/1998 |
| JP | 10-310663 | A | 11/1998 |
| JP | 2-885673 | B | 2/1999 |
| JP | 11-159950 | A | 6/1999 |
| JP | 11-201375 | | 7/1999 |
| JP | 2000-18486 | A | 1/2000 |
| JP | 2000-65287 | A | 3/2000 |
| JP | 2000-247917 | A | 9/2000 |
| JP | 2000-312875 | A | 11/2000 |

OTHER PUBLICATIONS

International Search Report for Application No. PCT/JP02/05398, Sep. 17, 2002 with partial English translation.

Supplementary Partial European Search Report for Application No. PCT/JP02/05398, filed May 31, 2002.

* cited by examiner

INSULATED BOX BODY, REFRIGERATOR HAVING THE BOX BODY, AND METHOD OF RECYCLING MATERIALS FOR INSULATED BOX BODY

THIS APPLICATION IS A U.S. NATIONAL PHASE APPLICATION OF PCT INTERNATIONAL APPLICATION PCT/JP02/05398.

TECHNICAL FIELD

The present invention relates to a refrigerator having an insulate box unit formed of rigid urethane foam and vacuum insulation material, and also relates to a method of recycling materials for insulation box unit.

BACKGROUND ART

Recent years have seen various efforts to encourage energy saving and resource saving for protecting our planet.

In terms of the energy saving, Japanese Patent Laid-Open No. S57-96852 discloses a technique of producing a highly insulation box unit. In the disclosure, vacuum insulation material disposed between the inner box and the outer box of an insulation box unit is integrally foamed with rigid urethane foam.

From the resource-saving point of view, recycling disposal appliances, such as a refrigerator and a television, has become increasingly valued; in particular, as for refrigerators, various ecological efforts have been made.

In an insulation box unit that is the major component of the refrigerator, metallic materials including iron plates are recyclable without great difficulty. Whereas, plastics, especially rigid urethane foam made of thermosetting resin, which is employed in quantity for the insulation material of the refrigerator, cannot be melted for recycling. Therefore, such materials have been conventionally buried, burnout, or used as a filler. To address the conventional disposal of plastics, a new processing-technology makes a proposition to decompose polymeric material, with supercritical, or sub-critical water employed in the process.

For example, Japanese Patent Laid-Open Application No. H10-310663 introduces a method of recovering polyurethane resin through decomposing. In the disclosure, polyurethane resin is subjected to chemical decomposition employing supercritical, or sub-critical water to recover raw material compound and reusable raw material derivatives in the polyurethane resin.

Japanese Patent No. 2885673 introduces a method in which polymeric material is chemically treated with supercritical or sub-critical water so as to be decomposed into oil components.

As the need for energy saving grows, there has emerged a need for providing a refrigerator having higher insulation efficiency; a larger area occupied by vacuum insulation material, i.e., an extended coverage of the vacuum insulation material to the surface area of the outer box has been required.

However, too-high coverage by the insulation material may cause troubles. Although conventional coverage within the range from 30% to 40% has no problem, a coverage exceeding the range may seriously affect the structural strength of the insulation box unit. In the box unit, the outer box and the inner box are integrally bonded with rigid urethane foam disposed between the two boxes, whereby structural rigidity of the insulation box unit is remained. However, employing a different kind of material, i.e., the vacuum insulation material in larger area in an insulation wall layer automatically decreases the thickness of the rigid urethane foam. Thus, the lack of rigidity caused by the thinned polyurethane foam can result in deformation in the insulation box unit.

Particularly, the deformation of the box unit becomes more pronounced in a refrigerator having two or more doors; the doors are not allowed to tightly fit to the body due to the distortion, which makes undesired gap at the gasket, thereby inviting poor insulation efficiency.

To avoid the distortion, there is a well known method in which density of the rigid urethane foam is greatly increased so as to provide large bending modulus that is an index of rigidity. The rigid urethane foam having an extensively increased density, however, increases conductive heat transfer in solids. As a result, against the purpose of heat insulation, the insulation efficiency of the rigid urethane foam will be largely affected. This contributes to decreasing insulation efficiency of the insulation box unit that is the essential target.

As the coverage of the vacuum insulation material increases, endothermic amount of the insulation box unit decreases; accordingly, this encourages energy saving. However, the efficacy of the energy saving moves down along saturation curve, after all, it is not rational in terms of acquiring a rewarded outcome that offsets investment costs.

Besides, when the coverage of vacuum insulation material is increased higher than it should be, it becomes necessary to prepare the material with nonstandard size and shape, and also necessary to dispose the material in a difficult-to-task section in the manufacturing processes. The facts have caused problem of extensive increase in the cost of the vacuum insulation material and production costs.

In the multi-layered insulation section formed of the rigid urethane foam and the vacuum insulation material, if a rigid urethane foam-filled wall has not enough thickness, the expanding foam decreases its flow performance. As a result, an inconsistent filling or poor filling decreases the insulation efficiency of a polyurethane foam-layer. Therefore, the insulation efficiency of a multi-layered insulation section may be smaller than it was expected, or on the contrary, the insulation efficiency may get worse. In particular, the structure having an extremely increased coverage of the vacuum insulation material has a risk of decreasing the insulation efficiency, because that the hard-to-flow polyurethane layer covers almost the inner face of the insulation box unit.

Furthermore, a poor insulation efficiency of vacuum insulation material itself further decreases the insulation capability in addition to the aforementioned decrease in the polyurethane part of the multi-layered insulation section. Accordingly, it has not achieved a noticeable energy-saving effect in spite of getting the coverage of the vacuum insulation material as high as possible.

From the viewpoint of resource-saving and recycling, employing the aforementioned method disclosed in Japanese Patent Laid-Open Application No. H10-310663 can recover raw material compound of the polyurethane resin and reusable raw material derivatives from rigid urethane foam.

The method, however, is not applicable for recycling an insulation box of a disposal refrigerator as its entirety; the supercritical water employing process cannot chemically decompose rigid urethane foam covered by the iron plate of the outer box or ABS resin of the inner box. On the other hand, various kinds of polymeric material, such as polypropylene resin for interior components, can be chemically decomposed by supercritical or sub-critical water. If an insulation box involving different kinds of members is subject to chemical decomposition, materials containing monomeric substances obtained from the process are dissolved into raw material compounds as impurity. Therefore, such raw material compounds having impurity is not reusable as rigid urethane foam.

In order to recover raw material compound of the polyurethane resin and reusable raw material derivatives as reusable industrial resource, it has been the essential issue that "pure" rigid urethane foam with no different members should be separated and classified from an insulation box unit to be discarded. Furthermore, it has been waited for an improved disposal method in which iron can be recovered so as to achieve high recovery efficiency as a whole system.

As another problem to be considered, the aforementioned raw material compound of the polyurethane resin and reusable raw material derivatives, which are obtained from the chemical decomposition, are determined by the chemical structure of the rigid urethane foam to be decomposed. That is, the chemical structure of the compound and derivatives depend on basic raw material forming the rigid urethane foam. It becomes therefore important that a recycling method suitable for the basic raw material forming rigid urethane foam should be employed.

Furthermore, it has been another challenge for encouraging recycling system that reusing the raw material compound of the polyurethane resin and reusable raw material derivatives obtained through chemical decomposition as insulation material for a refrigerator.

Besides, there has been a critical obstacle to promote recycling with high efficiency—proper methods of processing rigid urethane foam cannot be specified without identifying the basic raw material of the rigid urethane foam used for the insulation box unit as the major component of a disposal refrigerator.

DISCLOSURE OF THE INVENTION

To address the problems above, it is therefore an object to provide an insulation box unit capable of offering structural strength and high insulation efficiency in spite of an extended use of vacuum insulation material. It is another object to provide a new method of producing reprocessed material, and also to provide an insulation box unit and a refrigerator employing the reprocessed material. This will enhance recycling efficiency of an insulation box unit to be discarded, contributing to resource recycling.

In order to achieve the objects above, the insulation box unit of the present invention is formed of i) rigid urethane foam with a bending modulus of 8.0 MPa or greater and a density of 60 kg/m$^3$ or lower, and ii) vacuum insulation material. The rigid urethane foam with bending modulus greater than 8.0 MPa allows a box unit to have substantial strength, thereby the box unit is free from deformations caused by weight of goods stored therein. For increasing stiffness, the rigid urethane foam has a higher density, but it is kept not more than 60 kg/m$^3$,so that decrease in insulation efficiency due to increased solid thermal conductivity does not occur. Such an insulation box unit does not cause any problem in its quality, in spite of an extended use of the vacuum insulation material, providing an excellent insulation efficiency and therefore contributing to energy saving.

A further insulation box unit of the present invention is also formed of rigid urethane foam and vacuum insulation material. The coverage of the vacuum insulation material with respect to the surface area of the outer box is determined not less than 40% and not more than 80%. Greater-than-40% coverage of the vacuum insulation material with respect to the surface area of the outer box can enhance effect on energy saving. Besides, keeping the coverage not more than 80% can eliminate the needs not only to prepare the vacuum insulation material with out-of-standard size and shape, but also to dispose the material in a hard-to-task section in the manufacturing processes, with sufficient insulation efficiency maintained.

A recycling method of the present invention contains: i) a crushing process for crushing an insulation box unit; ii) a screening process for classifying the broken-down materials; iii) a foamed material-handling process for crushing urethane foam blocks separated from the box unit into powder; iv) a reusable material-preparing process for decomposing the urethane foam powder into raw material compounds of rigid urethane foam and various amines; and v) a raw material-producing process for producing the material of polyurethane by fractionating crude products. Through the processes above, rigid urethane foam, which is formed of tolylene di-isocyanate composition, is now recycled as the material of rigid urethane foam; to be more specific, crude products, which are obtained through a process using supercritical or sub-critical water, are fractionated to obtain tolylene di-isocyanate compounds and tolylene diamine polyether polyol, which are synthesized from tolylene diamine—one of the fractional components. In this way, the two materials are obtained and employed, as renewed materials for rigid urethane foam.

DETAILED DESCRIPTION OF CARRYING OUT OF THE INVENTION

Figure 1:
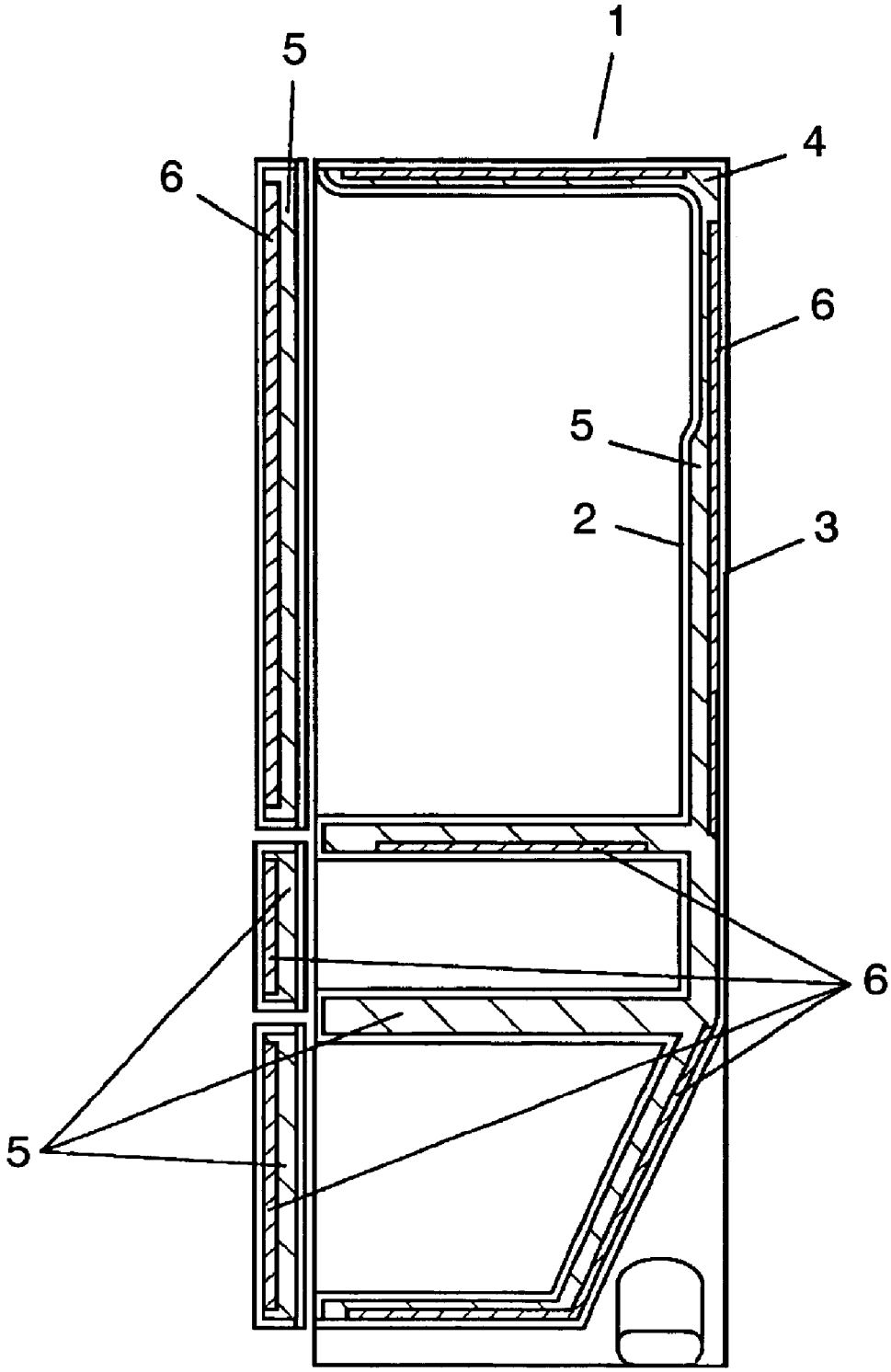
FIG. 1 is a sectional view of an insulation box unit of a first and a third embodiments of the present invention.

Hereinafter will be described an insulation box unit, a refrigerator, and a method of recycling materials of the present invention according to the exemplary embodiments.

The insulation box unit of the present invention is formed of i) rigid urethane foam with a bending modulus of 8.0 MPa or greater and a density of 60 kg/m$^3$ or lower, and ii) vacuum insulation material. At the same time, the coverage of the vacuum insulation material with respect to the surface area of the outer box is determined greater than 40%. In spite of such an extended coverage of the vacuum insulation material, the rigid urethane foam, by virtue of its 8.0 MPa-or-greater bending modulus, can provide the box unit with a substantial strength. That is, the box unit is free from deformations caused by weight of goods stored therein. For increasing stiffness, the rigid urethane foam has a higher density, but it is kept at most 60 kg/m$^3$, so that decrease in insulation efficiency due to increased conductive heat transfer in solids does not occur. Such an insulation box unit has no problem in its quality, despite of an extended use of the vacuum insulation material, providing an excellent insulation efficiency and therefore contributing to energy saving.

In another insulation box unit of the present invention, the coverage of the vacuum insulation material with respect to the surface area of the outer box is greater than 40%, and three or more doors are attached. Despite of the extended coverage of the vacuum insulation material and plural doors, the rigid urethane foam, by virtue of the increased bending modulus, can provide the box unit with a substantial strength. That is, the box unit is free from deformations caused by weight of goods stored therein. A great stiffness is particularly essential to an insulation box unit having three or more doors; no deformation occurs in the insulation box unit structured above. For increasing stiffness, the rigid urethane foam has a higher density, but it is kept at most 60 kg/m$^3$, so that decrease in insulation efficiency due to increased heat transfer of solids does not occur. Such an insulation box unit has no problem in its quality, despite of an extended use of the vacuum insulation material, providing an excellent insulation efficiency and therefore contributing to energy saving.

A still further insulation box unit of the present invention employs the rigid urethane foam, which is made by reacting a) isocyanate components formed of tolylene di-isocyanate compounds with b) pre-mix components formed of polyol, a foam stabilizer, a catalyst, and a foaming agent. Employing tolylene di-isocyanate allows the product obtained to have a structure in which reactive functional groups closely exist via aromatic ring, thereby providing a resin having a high elasticity modulus. Therefore, there is no need of getting extreme increase in density of the rigid urethane foam. Accordingly, the urethane foam has no undesired effect of heat transfer of solids, retaining excellent insulation efficiency. As a result, despite of having greater-than-40% coverage of the vacuum insulation material with respect to the surface area of the outer box, the insulation box unit employing the urethane foam can provide satisfying structure strength and insulation efficiency. The high strength and insulation efficiency is also given to an insulation box unit having three-or-more doors and the extended coverage of vacuum insulation material.

In a still further insulation box unit of the present invention, water as a foaming agent of the rigid urethane foam forming the box unit generates carbon dioxide gas by reaction with isocyanate for foaming. At the same time, the small molecular weight of water provides a strong reactive bond in the molecular structure of the urethane foam obtained. Therefore, there is no need of getting extreme increase in density of the rigid urethane foam. Accordingly, the urethane foam has no undesired effect of heat conduction in solids caused by the increase in density, retaining excellent insulation efficiency. As a result, despite of having greater-than-40% coverage of the vacuum insulation material with respect to the surface area of the outer box, the insulation box unit employing the urethane foam can provide satisfying structure strength and insulation efficiency. The high strength and insulation efficiency is also given an insulation box unit having three-or-more doors and the extended coverage of vacuum insulation material.

Besides, such structured rigid urethane foam assures safety in disposal work because the urethane foam releases no hazardous material but aforementioned carbon dioxide gas when it is crushed.

The material-producing method of the present invention contains: i) a crushing process for crushing an insulation box unit; ii) a screening process for classifying the broken-down materials fed from the crushing process into iron, non-ferrous metal, wastes including resin, and the like; iii) a foamed material-handling process for breaking down urethane foam blocks, which is separated from the wastes in the crushing process into powder by grinding, crushing, or the like; iv) a reusable material-preparing process for 1) processing the urethane foam powder into liquid compounds through aminolysis or glycolysis reactions, 2) filtering out impurities, such as tiny pieces of resin and crushed metal, from the components, and then 3) decomposing it into raw material compounds of rigid urethane foam and various amines by chemical reaction employing supercritical and sub-critical water; and v) a raw material-producing process for producing the material of polyurethane by fractionating crude products. Through the processes above, rigid urethane foam, which is formed of tolylene di-isocyanate composition, is now recycled as the material of rigid urethane foam; to be more specific, crude products, which are obtained through a process using supercritical or sub-critical water, are fractionated to obtain tolylene di-isocyanate compounds and tolylene diamine series polyether polyol, which are synthesized from tolylene diamine—one of the fractional components. In this way, the two materials are synthesized and employed as renewed materials for rigid urethane foam.

In a still further insulation box unit of the present invention, the rigid urethane foam mainly contains tolylene di-isocyanate compounds and tolylene diamine polyether polyol. The two major materials, mixed together with a foam stabilizer, a catalyst, a foaming agent, are injected between the outer box and the inner box. Foaming and curing processes form the material into rigid urethane foam. In this way, the raw materials, which are extracted through decomposition and synthesis processes from rigid urethane foam made of tolylene di-isocyanate compounds, are now reused for producing another rigid urethane foam. It is thus possible to obtain an insulation box unit that encourages resource saving.

A still further refrigerator of the present invention has a tag that has a record of the raw materials of the rigid urethane foam employed for the insulation box unit of the refrigerator. By virtue of the tag, a person involving the recycle work can easily identify the raw material of the polyurethane foam used for the refrigerator to be recycled. This can determine proper methods of processing and raw-material producing according to the materials recorded on the tag, thereby encouraging resource saving.

A still further refrigerator of the present invention has a tag on which data of material types of the rigid urethane foam are recorded. By reading the information, a person involving the recycle work can determine a proper method of processing the rigid urethane foam.

Still another insulation box unit of the present invention is formed of rigid urethane foam and vacuum insulation material. In the box unit, the coverage of the vacuum insulation material ranges from 40% to 80% with respect to the surface area of the outer box. In installing of the vacuum insulation material, priority should be given to an area with larger conductive heat transfer. The vacuum insulation material whose coverage of about 40% or greater with respect to the surface area of the outer box can keep endothermic loading amount in a desired level, enhancing energy saving. Greater-than-50% coverage is more preferable.

Keeping the coverage at most 80% prevents the effect of the use of the vacuum insulation material from reaching the saturated level, whereby the endothermic loading amount is effectively suppressed. That is, employing the vacuum insulation material with its utility value increased can promote energy saving. The less-than-80% coverage eliminates inefficiencies that invite an extreme decline of the effectiveness as it was expected, such as needs to prepare the vacuum insulation material with nonstandard size and shape, and to dispose the material in a difficult-to-task section. As a result, low operating costs brought by the energy-saving structure can serve as a counterbalance to an increased initial production cost by introduction of the insulation box unit.

In a yet further insulation box unit of the present invention, the vacuum insulation material is disposed on all the six planes—top, bottom, front, back, and both sides—of the box unit. Disposing the vacuum insulation material on all of the six planes so that the coverage with respect to the surface area of the outer box is in the range from 40% to 80%, thereby encouraging energy saving.

According to a still further insulation box unit of the present invention, in an area of the box unit where the temperature should be kept at freezing temperature, the multi-layered insulation section formed of a rigid urethane foam-layer and a vacuum insulation material-layer has a consistent layer-thickness in the range from 20 mm to 50 mm with the exception of the doors' sections. The thickness range above allows the rigid urethane foam not to lose flow performance within a layer, thereby preventing the multi-layered insulation section from low insulation efficiency due to poor filling and inconsistency in the polyurethane foam. Therefore, the multi-layered insulation section formed of the rigid urethane foam and the vacuum insulation material can maintain proper insulation efficiency. It is thus possible to enhance energy saving—even in the freezing-temperature area having a steep temperature-gradient between the inside and the outside of the box unit—by taking advantage of the vacuum insulation material.

Furthermore, keeping the thickness of the insulation layer not-more-than 50 mm, except for the doors, can practically increase volumetric efficiency of internal space with respect to the entire volume of an insulation box unit.

According to a still further insulation box unit of the present invention, in an area of the box unit where the temperature should be kept at refrigerating temperature, the multi-layered insulation section, which is formed of a rigid urethane foam-layer and a vacuum insulation material-layer, has a consistent layer-thickness in the range from 20 mm to 40 mm with the exception of the doors' sections. The thickness range above allows the rigid urethane foam not to lose flow performance within a layer, thereby preventing the multi-layered insulation section from low insulation efficiency due to poor filling and inconsistencies occurred in the polyurethane foam. Therefore, the multi-layered insulation section formed of the rigid urethane foam and the vacuum insulation material can maintain proper insulation efficiency in the refrigerating-temperature zone having a relative small temperature-gradient between the inside and the outside of the box unit. It is thus possible to provide an insulation box unit having well-balanced advantages of an energy-saving effect brought by the vacuum insulation material and an enhanced volumetric efficiency of internal space with respect to the entire volume of an insulation box unit.

According to a still farther insulation box unit of the present invention, thickness of the vacuum insulation material is determined to be in the range from 10 mm to 20 mm. The thickness range above allows the rigid urethane foam not to lose flow performance within a layer even in a section having a relatively thin wall, i.e., a thickness in the range from 20 mm to 30 mm. This can broaden the area in which the vacuum insulation material can be disposed with no loss of insulation efficiency of the multi-layered-insulation section. As a result, the increased coverage of the vacuum insulation material enhances the effect on energy saving.

According to a still further insulation box unit of the present invention, the vacuum insulation material is formed of a core material and gas-barrier film covering the core material. Specifically, the core material is an inorganic fiber aggregate. Employing inorganic fiber can curb, with no change over time, a generation of gasses in the vacuum insulation material. In addition, this eliminates a step for filling the inner bag with a powder, which is a necessary process when a powder is used as the core material in manufacturing the vacuum insulation material, thereby improving in production efficiency and working environment. It is therefore possible to provide an insulation box unit with enhanced production efficiency and a long-time reliability, in spite of an extended use of the vacuum insulation material with an increased coverage.

According to a still further insulation box unit of the present invention, the thermal conductivity of vacuum insulation material and rigid urethane foam so as to have a ratio ranging from 1:15 to 1:5. That is, the thermal conductivity of the vacuum insulation material is determined in the range from 0.0010 W/m·K to 0.0030 W/m·K when the rigid urethane foam has a thermal conductivity of 0.015 W/m·K The ratio above allows the rigid urethane foam not to lose flow performance within a layer, thereby maintaining preferable insulation efficiency as a multi-layered insulation section despite of having a small layer thickness. It is thus possible to provide an insulation box unit in which the vacuum insulation material is extensively used in the box unit. The structure satisfies a demand that the vacuum insulation material should be used even in a section having a relatively small wall thickness, achieving the energy-saving effect as expected.

According to a yet further insulation box unit of the present invention, vacuum insulation material is embedded in rigid urethane foam at an intermediate section between the outer box and the inner box. In the insulation box unit structured above, all the outer surfaces of the vacuum insulation material have an intimate contact with the rigid urethane foam. Compared to the structure having a direct contact of the vacuum insulation material with the outer box or the inner box of the insulation box unit, the embedded structure has no decrease in strength of an insulation box unit due to peeling-off of the insulation material.

In particular, compared to the structure in which vacuum insulation material is attached to the outer box, the aforementioned "embedded" structure allows a projected area of the heat transfer between the outside and the inside of the insulation box unit to be effectively covered at a position embedded in the urethane foam. Therefore, the embedded structure can increase in-real coverage per coverage area.

According to a still further insulation box unit of the present invention, a plane in which vacuum insulation material is embedded in rigid urethane foam at an intermediate section between the outer box and the inner box is at least disposed on a side plane of the box unit. That is, the side planes of the outer box have no direct contact with the vacuum insulation material. On the other hand, in a "direct contact" structure, a foaming agent of rigid urethane foam agglomerated in a gap between the outer box and the vacuum insulation material may expand or contract in response to changes in surrounding temperature, which has often resulted in deformation of the outer box. In contrast, aforementioned structure of the present invention, since it is free from the phenomena, can prevent the insulation box unit from having a poor side-appearance as a conspicuous structural defect, thereby maintaining excellent quality as a product.

A still further refrigerator of the present invention contains an insulation box unit introduced above, a cooling compartment formed within the insulation box unit, and a cooling system for cooling the compartment. Employing the insulation box unit having high coverage of the vacuum insulation material with respect to the surface area of the outer box can effectively contribute to energy saving. At the same time, the structure an enhanced volumetric efficiency of internal space even though its space-saving compact body can provide an environment friendly refrigerator.

Hereinafter will be described the insulation box unit, the refrigerator, and the method of producing materials of the present invention according to the exemplary embodiments with reference to accompanying drawings.

First Exemplary Embodiment

FIG. 1 shows an insulation box unit of the first embodiment. Insulation box unit 1 includes synthetic resin-made inner box 2 and metallic outer box 3. In space 4 formed between inner box 2 and outer box 3, rigid urethane foam 5 and vacuum insulation material 6 are arranged in a multi-layered structure. In the manufacturing process of insulation box unit 1, vacuum insulation material 6 is bonded to outer box 3 in advance, and then the raw material of rigid urethane foam 5 is injected into space 4 to have an integral expansion. In the structure above, the coverage of insulation material 6 with respect to the surface area of outer box 2 was compared in the cases of 50% and 80%.

Rigid urethane foam 5 is produced by mechanical-mixing a premix component with an isocyanate component that is made of tolylene di-isocyanate composition. The premix is prepared by mixing, by weight, 3 parts of catalyst, 3 parts of foam stabilizer, 2 parts of water as a foaming agent, 0.5 parts of formic acid as a chemical reaction regulator to 100 parts by weight of polyether with hydroxyl value of 380 mg KOH/g.

The rigid urethane foam disposed on a side of insulation box unit 1 of the exemplary embodiment 1 has physical properties of: 45 Kg/m$^3$ for density; 8.5 MPa for bending modulus; and 0.022 W/m·K for coefficient of thermal conductivity. Compared to the physical properties of prior-art rigid urethane foam, the polyurethane foam of exemplary embodiment 1 has 1.3 times for density, and 1.5 times for bending modulus greater than those of the conventional one. As for the thermal conductivity, they are almost the same. On the other hand, according to the structure introduced in exemplary embodiment 2, the density is increased to 55 Kg/m$^3$ and accordingly, the bending modulus measures 10.0 MPa and the thermal conductivity measures 0.023 W/m·K. Both the structures of exemplary embodiments 1 and 2 satisfy the structural strength of the box unit and insulation efficiency.

Another two more insulation box units with different physical properties were prepared as comparison examples 1 and 2. In the rigid urethane foam of comparison example 1 whose density was increased to 70 Kg/m3, bending modulus and thermal conductivity were measured to be 13.0 MPa and 0.026 W/m·K, respectively. The structure with such a physical property invites serious degradation of insulation efficiency. On the other hand, the structure of comparison example 2 whose density was lowered to 35 Kg/m$^3$ decreased the structural strength of the box unit. Table 1 below shows the results.

TABLE 1

| | | Physical properties of rigid urethane foam | | | Quality of the insulation box unit | |
|---|---|---|---|---|---|---|
| | Isocyanate compositions | Density (kg/m$^3$) | Bending modulus (MPa) | Thermal conductivity (W/m · K) | Stiffness | Insulation efficiency |
| Exemplary Embodiment 1 | Tolylene di-isocyanate | 45 | 8.5 | 0.022 | OK | OK |
| Exemplary Embodiment 2 | | 55 | 10.0 | 0.023 | OK | OK |
| Comparison example 1 | Tolylene di-isocyanate | 70 | 13.0 | 0.026 | OK | No good |
| Comparison example 2 | Diphenylmethane di-isocyanate | 35 | 5.5 | 0.022 | Deformed | OK |

Note)
The quality of the insulation box unit was evaluated on the structure having 80% coverage.
The structure having 50% coverage has almost the same result.

To complete a refrigerator (not shown), compartment parts (not shown) including shelves and a refrigerating system (not shown) are added to insulation box unit 1 of the first and second embodiments. In order to check whether deformations occur or not, the refrigerator completed as a product was subjected to a refrigerating test, and a load-bearing test, with foods put on the shelves. For the doors, opening/closing operations were performed over and over again. Through the tests above, neither deformation nor a gap between a door section and a flange was observed. It is apparent from the results that the insulation box unit has an excellent quality.

Second Exemplary Embodiment

Figure 2:
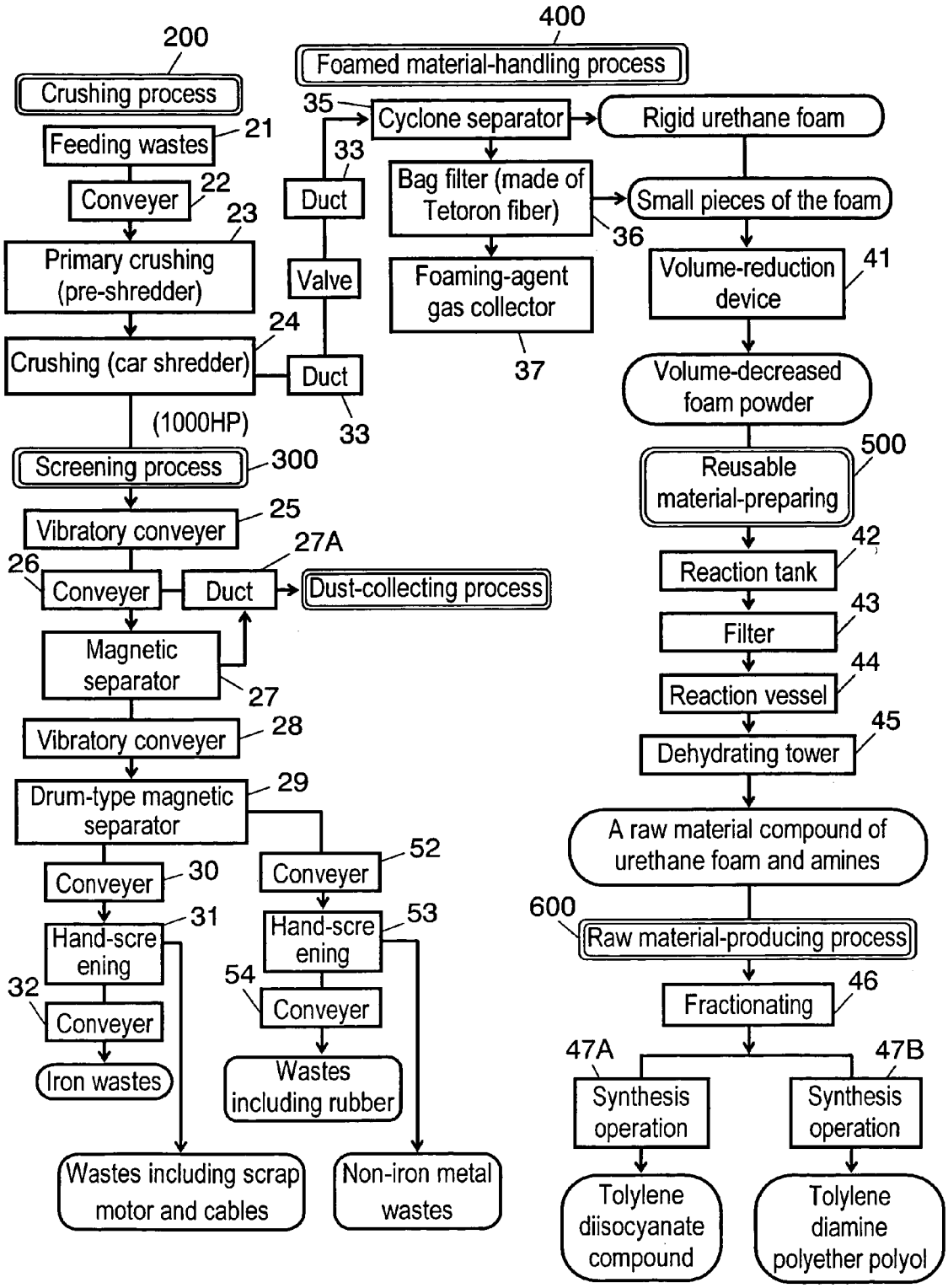
FIG. 2 is a flow chart illustrating a recycling method of a second embodiment.

FIG. 2 illustrates the procedures of a recycling method of the second embodiment.

First, the outline of the waste-disposal process is described.

Insulation box unit 1 to be recycled undergoes crushing process 200 and then screening process 300. In process 300, the materials broken down in process 200 are classified by weight and reclaimed according to predetermined material groups. In foamed material-handling process 400 processing light (in weight) wastes, rigid urethane foam 5 and blowing gas of a refrigerator are recovered. Urethane foam 5 fed from process 400 is brought into reusable material-preparing process 500 to obtain the material compounds of rigid urethane foam and amine groups as decomposition products.

Now will be described the details of the process with reference to FIG. 2.

In step 21 of FIG. 2, the wastes of insulation box unit 1 brought into the waste disposal facility are fed into crushing process 200. When a refrigerator is recycled, refrigerant in the refrigerator should be removed before being fed into the process. The wastes are then carried to a pre-shredder by a conveyer in step 22.

Roughly crushed by the pre-shredder in primary crushing of step 23, the wastes are fed into a breaker in step 24, where an approx. 1000-hp single-axis car shredder further crushes the wastes into smaller pieces.

In step 25, a vibratory conveyer, which is disposed under the feed-out section of the car shredder, separates the wastes into heavy wastes including iron and non-ferrous metal and light wastes other than rubbers, and each group of the wastes is carried by a belt conveyer or the like in step 26.

Through a magnetic separator in step 27, a vibratory conveyer in step 28, a drum-type magnetic separator in step 29, the wastes are separated into two groups according to the wastes include metal of iron group or not.

In step 27A, light dust stirred up through steps 26 and 27 is collected and carried to a dust-collecting process (not shown).

A conveyer in step 30 carries the wastes separated in step 29. In step 31, the wastes on the conveyer are now separated by hand-screening into an iron waste and a non-iron waste. The scrap iron is moved onto a carrying cart in step 32, whereas the non-iron rubbish including scrap motor and cables are manually separated.

In conveyer-carrying, specifically between the steps 52 and step 54, non-ferrous metal undergoes hand-screening step 53, where non-ferrous metal is manually taken out of the non-iron wastes from step 29. The rest of wastes left on the conveyer are collected as scrap including rubber.

According to the present invention, as described above, crushing process 200 includes step 21 through step 24, screening process 300 includes step 25 through step 32, and the other branch of step 52 to step 54.

In step 33, rigid urethane foam 5 separated in crushing process 200 is sucked into a cyclone separator, via ducts, in foamed material-handling process 400. The cyclone separator in step 35 catches relatively large blocks of rigid urethane foam 5. On the other hand, foaming agent gas in the urethane foam is captured, together with small pieces of urethane foam, by a bag filter of the cyclone separator in step 36. Passed through the filter, the foaming agent gas is fed into foaming-agent gas collector in step 37. In the case that carbon dioxide gas is employed for the foaming agent gas, the gas is not fed into the collector. On the other hand, when cyclopentane is used for the foaming agent gas, it should be collected by a collector of explosion-proofed system.

In step 41, the blocks of rigid urethane foam 5 fed from the cyclone separator in step 35, and smaller pieces of the foam captured by the bag filter in step 36 are carried to a volume reduction device. The reduction device, which is formed of a pressing machine and screw-type compressor, reduces the volume of the blocks and the small pieces of the urethane foam and crushes them into powder by shearing force occurred in compressing. In grinding with compression, the application of heat vaporizes the foaming agent gas dissolved in the urethane foam. This can be an effective collection method.

As described above, foamed material-handling process 400 includes step 33 through step 41.

Next, in step 42, the powder of rigid urethane foam 5 from foamed material-handling process 400 is carried to a reaction vessel to undergo aminolysis and glycolysis reactions in which the polyurethane foam powder mixed with ethylene glycol, monoethanol amine, or tolylene diamine is heated. Through the reactions, liquid material is obtained.

In step 43, a filter filters out impurity solid particles in the liquid material generated in step 42. After that, the liquid material is fed into a reaction vessel, together with highly heated and pressurized water. With the vessel maintained in a supercritical or sub-critical condition, the material undergoes decomposition process in step 44.

In step 45, a dehydrating tower removes water and carbon dioxide from the liquid obtained through the decomposition process. Through the aforementioned steps, a raw material compound of rigid urethane foam 5 and amine groups are obtained.

Reusable material-preparing process 500, as described above, includes step 42 through step 45.

In step 46 contained in raw material-producing process 600, the breakdown product undergoes fractional distillation. In the process, reusable raw material is produced from tolylene diamine that is a component obtained through the fractional distillation, to be more specific, tolylene di-isocyanate composition is obtained through synthesis in step 47A, and similarly, tolylene diamine-series polyether polyol is obtained through synthesis in step 47B.

Third Exemplary Embodiment

An insulation box unit of the third embodiment is described with reference to FIG. 1.

Rigid urethane foam is produced by mechanical-mixing a premix component, which has the tolylene diamine obtained in the second embodiment as a parent material, with an isocyanate component formed of the tolylene di-isocyanate composition also obtained in the second embodiment. The premix above is prepared by mixing, by weight, 3 parts of catalyst, 3 parts of foam stabilizer, 2 parts of water as a foaming agent, 0.5 parts of formic acid as a chemical reaction regulator to 100 parts by weight of tolylene diamine series polyether polyol with hydroxyl value of 380 mg KOH/g.

After that, an insulation box unit is to be produced as is described in the first embodiment. That is, the insulation box unit is formed of inner box 2, and outer box 3 to which vacuum insulation material is bonded in advance. After that, rigid urethane foam 5 is injected in space 4 between inner box 2 and outer box 3 to form insulation layers therein.

Fourth Exemplary Embodiment

Figure 3:
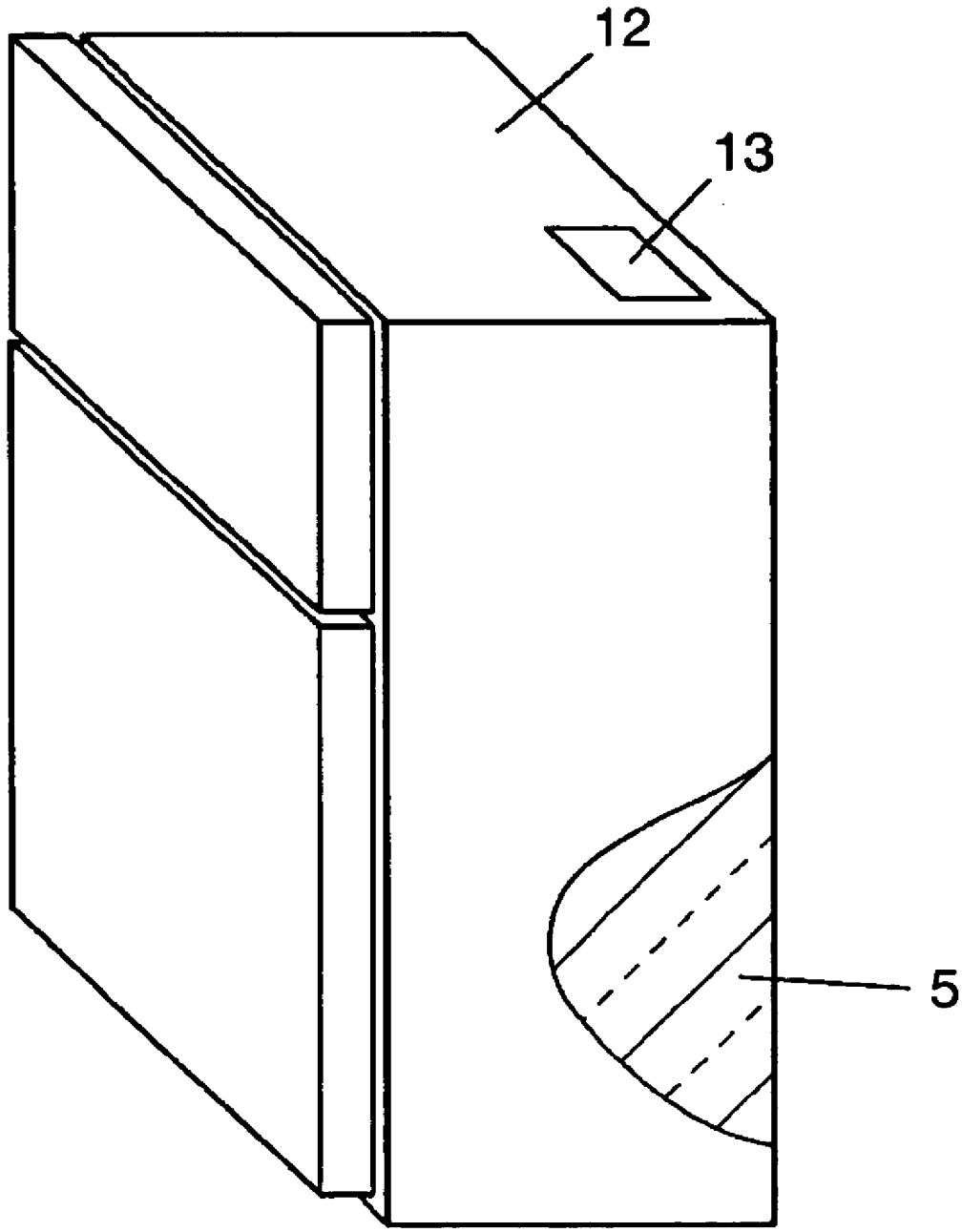
FIG. 3 is a perspective view showing a refrigerator having a notch of a fourth embodiment.

FIG. 3 shows a refrigerator in accordance with the fourth embodiment. Refrigerator 12 in FIG. 3 has rigid urethane foam 5 as insulation material. Tag 3 is attached to the refrigerator. It has a record of the material type of rigid urethane foam 5 used in the refrigerator.

The material type of urethane foam may be magnetically or optically recorded in tag 13, as a memory card including SmartMedia, or bar-code. Reading data stored in tag 13 prior to the crushing process allows an operator to select a method suitable for the urethane foam in the refrigerator.

Fifth Exemplary Embodiment

An insulation box unit of the fifth embodiment and a refrigerator having the insulation box unit will be described, referencing to FIGS. 4 through 6.

Figure 4:
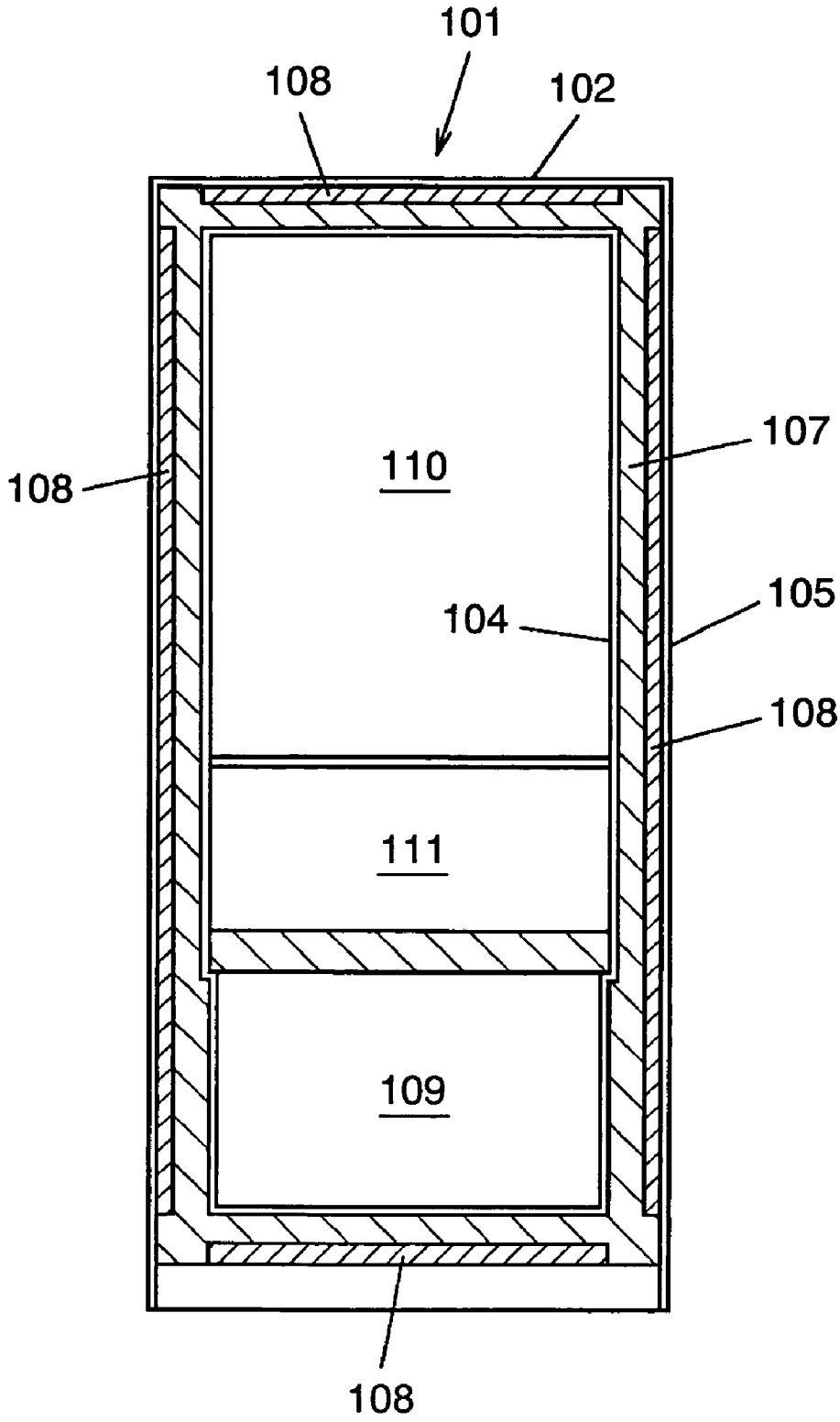
FIG. 4 shows a cross-sectional view seen from the front side of a refrigerator of a fifth embodiment.
Figure 5:
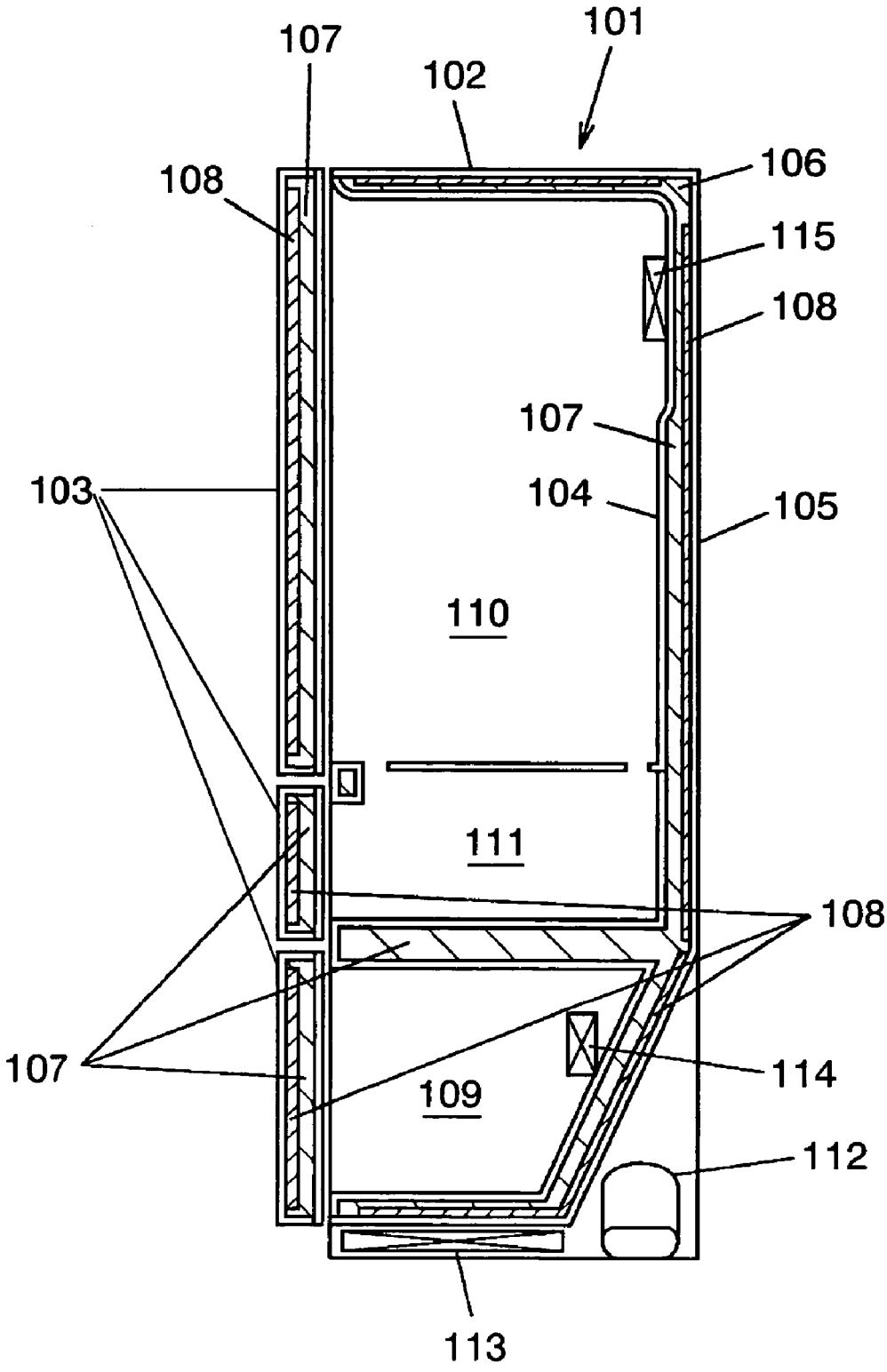
FIG. 5 shows a cross-sectional view seen from the side of the refrigerator of the fifth embodiment.

Refrigerator 101 shown in FIGS. 4 and 5 has insulation box unit 102 including doors 103. Insulation box unit 102 is formed of synthetic resin-made inner box 104 and metallic outer box 105 made of iron plates and other materials. In space 106 formed between inner box 104 and outer box 105, rigid urethane foam 107 and vacuum insulation material 108 are disposed in a multi-layered structure. To manufacture insulation box unit 102, vacuum insulation material 108 is bonded to outer box 105 in advance, and then the raw material of rigid urethane foam 107 is injected in space 106 to have an integral expansion.

Insulation box unit 102 has vacuum insulation material 108 on surfaces of its sides, top, rear, bottom, and doors 103. The coverage of the vacuum insulation material with respect to the surface area of outer box 105 reaches 80%. Insulation box unit 102 contains freezer compartment 109, refrigerator compartment 110, and vegetable-stock compartment 111. Freezer compartment 109 is set in a freezing-temperature zone (approx. −15° C. to −25° C.). On the other hand, refrigerator compartment 110 and vegetable-stock compartment 111 is controlled in a refrigerating-temperature zone (approx. 0° C. to 10° C.). The cooling system of the refrigerator is formed of compressor 112, condenser 113, cooling devices 114 and 115.

Refrigerator 101 is formed of i) insulation box unit 102 having freezer compartment 109, refrigerator compartment 110, and vegetable-stock compartment 111, and ii) a cooling system for cooling the compartments above, which includes compressor 112, condenser 113, cooling devices 114 and 115.

Figure 6:
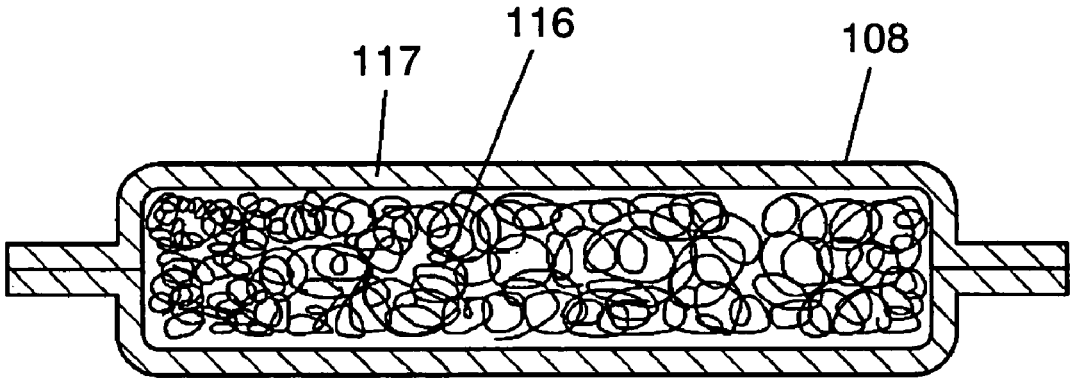
FIG. 6 is a cross-sectional view of vacuum insulation material employed for the refrigerator of the fifth embodiment.

In FIG. 6, vacuum insulation material 108 is formed such that i) heated and dried inorganic fiber aggregate 116 including glass wool is inserted in covering material 117, and then ii) the openings of material 117 are sealed, with the interior of material 117 maintained under vacuum.

As for vacuum insulation material 108 of the present invention, inorganic fiber aggregate 116 with a fiber diameter ranging 0.1 μm to 1.0 μm. The thermal conductivity of the vacuum insulation material is determined to 0.0015 W/m·K. On the other hand, the thermal conductivity of rigid urethane foam 107 is determined to 0.015 W/m·K. The adjustment provides a 1 to 10 vacuum-insulation-material to rigid-urethane-foam ratio in thermal conductivity.

One side of covering material 117 is formed of a surface protective layer of 12-μm thick polyethylene terephthalate; 6-μm thick aluminum foil disposed in a middle section; and laminated film of 50-μm thick high density polyethelene as a thermal seal layer. The other side of covering material 117 is formed of a surface protective layer of 12-μm thick polyethylene terephthalate; a film layer in which the inner side of 15-μm thick ethylene-vinyl alcohol copolymer resin compound has a layer of evaporated aluminum; and laminated film of 50-μm thick high density polyethelene as a thermal seal layer.

Besides, covering material 117 has a nylon-resin layer over the surface protective layer to increase the resistance of the surface to scratch.

The insulation layer of insulation box unit 102 has different thickness ranges according to the aforementioned temperature zone; in the freezing-temperature zone, i.e., freezer compartment 109, including the sections having a thin wall at the openings, (with the exception of doors 103), the thickness ranges 25 mm to 50 mm. In the refrigerating-temperature zone, i.e., refrigerator compartment 110 and vegetable-stock compartment 111, the thickness ranges 25 mm to 40 mm. Each insulation layer has 15-mm thick vacuum insulation material 108 therein. Besides, the insulation layer is so designed that rigid urethane foam 107 can keep the filling thickness of at least 10 mm.

In using vacuum insulation material 108 with an extended use so as to increase the coverage of it as possible in a refrigerator structured above, problems arise—there is a need for preparing the material with nonstandard size and shape at sections having various components (not shown), at sections with irregularities, or sections having pipes and drain hoses. In such sections, attachment efficiency cannot be increased.

Besides, in terms of a projected area of conductive heat transfer, even if vacuum insulation material 108 is extended to each edge of the surfaces, noticeable improvements in insulation efficiency would not be expected in some sections: each corner of insulation box unit 102, and the separating sections between freezer compartment 109 and vegetable-stock compartment 111.

From the reason above, an extensive coverage exceeding 80% (with respect to the surface area of outer box 105) of vacuum insulation material 108 can no longer enhance the insulation efficiency because it has reached "a saturated level". That is, too-high coverage of the material, on the contrary, hampers the improvements in insulation efficiency.

To address the problem above, according to the structure of the embodiment, the coverage of vacuum insulation material 108 is kept at most 80% with respect to the surface area of outer box 105. The vacuum insulation material can thus effectively suppress endothermic loads without falling into the saturated condition, thereby enhancing energy-saving effect.

Furthermore, employing large-sized vacuum insulation material 108 enough for covering each surface—the side, top, rear, bottom, front (i.e., doors 103)—can contribute to an improved efficiency in installing work.

Therefore, the structure above can eliminate the aforementioned inefficiencies—the need for preparing the material with nonstandard size and shape, and the need for installing the material in a difficult-to-task section in the manufacturing processes. At the same time, the structure of the embodiment provides an optimal operation cost in the life cycle. That is, the decreased operation cost by the energy-saving effect serves as a counterbalance to the initially raised production cost of refrigerator 1 that employs insulation box unit 102.

Although the embodiment introduces the structure having an 80%-coverage of vacuum insulation material 108 (with respect to the surface area of outer box 105), an approx. 75% coverage achieves the almost the same insulation effect, with some constraints on efficiency in attachment operations. That is, in the insulation box unit, the thickness of the insulation material overlaps at around the perimeter of each surface (approx. 50 mm away from each edge), or at the dividing section between the compartments. The insulation material can be disposed so as not to overlap with each other, because such overlapped sections are out of the thermal conduction projected area. Similarly, considering proper filling condition of rigid urethane foam 107 at the perimeter sections of the openings, the locating point of vacuum insulation material 108 can be shifted inwardly from the perimeter sections. Insulation box unit 102 of the embodiment has dimensions of 1800 mm in height, 675 mm in width, and 650 mm in depth.

The insulation material should be disposed in order of sections having a larger temperature gradient. The coverage of the insulation material exceeds 40% (with respect to the surface area of outer box 105) can effectively suppress endothermic loads of the insulation box unit, thereby enhancing energy-saving effect. Higer-than-50% coverage is further preferable.

Doors 103 has a relatively small temperature-gradient between the outside and the inside, compared to other sections in insulation box unit 102, which are affected by heat exhausted from compressor 112 and condenser 113. Besides, doors 103 need strength enough for holding goods put on the shelves and trays attached to the door. In addition, vacuum insulation material 108 disposed on the doors may peel off the surface due to repeated door-opening/closing operations. Considering the facts above, eliminating vacuum insulation material 108 from doors 103 can be a rational option; instead, the insulation material disposed on the rest sections of insulation box unit 102 increases the insulation efficiency to compensate for the absence of the material on the door sections. In such a structure, the optimal coverage of vacuum insulation material 108 will be approx. 53%.

In the structure, each compartment of insulation box unit 102 is surrounded by an insulation layer, which is formed of rigid urethane foam 107 and vacuum insulation material 108. As described earlier, the insulation layer has different thickness-ranges according to the temperature zone; in the freezing-temperature zone, i.e., freezer compartment 109, including the sections having a thin wall at the openings, with the exception of doors 103, the thickness is in the range from 25 mm to 50 mm. In the refrigerating-temperature zone, i.e., refrigerator compartment 110 and vegetable-stock compartment 111, including the sections having a thin wall at the openings, with the exception of doors 103, the thickness ranges 25 mm to 40 mm. Each insulation layer has 15-mm thick vacuum insulation material 108 therein. Besides, the insulation layer is so designed that rigid urethane foam 107 can keep the filling thickness of at least 10 mm. The thickness ranges allow the rigid urethane foam not to lose flow performance within the layer, which can prevent the insulation layer from decrease in insulation efficiency due to poor filling and inconsistency in the polyurethane foam.

As described above, the structure of the embodiment maintains a proper thickness of vacuum insulation material 108 to provide optimum insulation efficiency. The structure also enhances the insulation efficiency of rigid urethane foam 107 to a sufficient level, so that the multiple insulation layers formed of the two materials above can provide high insulation efficiency. In particular, the effect is particularly noticeable in the freezing-temperature zone with a large temperature gradient between the inside and the outside of a refrigerator.

Generally, a freezer compartment has a relatively small volume ratio with respect to the entire structure. As described above, a less-than-50 mm thickness of the insulation layer allows the freezer compartment 109 to have a larger interior without impact on the appearance of the refrigerator. It will be understood that insulation material 108 is effectively employed in the compartment.

On the other hand, a less-than-40 mm thickness of the insulation layer can provide well-balanced advantages: an energy-saving effect enhanced by the use of vacuum insulation material 108, and improved inner-volume efficiency in the refrigerator in the refrigerating-temperature zone having a relatively small temperature-gradient.

Furthermore, making the entire volume of the refrigerator compact, with the improved inner volume efficiency by the use of the insulation material 108 maintained, allows refrigerator 101 to have a small footprint.

Doors 103 need a strength enough for holding goods put on, for example, the shelves and trays attached to the door. Furthermore, doors 103 have some attachment with irregularity—a handle, an operation panel for temperature control, and a display. This is the reason why the insulation layer used in the door section is not given the thickness in the range like others.

A not-more-than 10 mm thickness of vacuum insulation material 108 can manage to keep not only the "heat bridge" effect via covering material 117 in a negligible level, but also the insulation efficiency as the insulation material alone. At-least-20 mm wall thickness of the multiple insulation layers allows the vacuum insulation material to keep the thickness of 10 mm, thereby providing the insulation efficiency as intended.

On the other hand, increasing vacuum insulation material thickness can obtain further preferable insulation efficiency. However, once the thickness exceeds 20 mm, the insulation efficiency for one plane reaches a saturation level, so that further effect cannot be expected. It is preferable to share the thickness with other planes. From the reason above, the proper thickness of vacuum insulation material 108 is in the range from 10 mm to 20 mm.

Vacuum insulation material 108 has inorganic fiber aggregate 116 as a core material. The fiber has a diameter in the range from 0.1 μm to 1.0 μm. Compared to the thermal conductivity of rigid urethane foam 107 (=0.015 W/m·K), vacuum insulation material 108 has a thermal conductivity of 0.0015 W/m·K, which is only one-tenth of the polyurethane foam 107. Therefore, increasing the coverage of the insulation material to 80% can provide an exceedingly high insulation efficiency, accelerating energy saving. Furthermore, the use of inorganic fiber aggregate 116 can suppress a generation of gasses in the vacuum insulation material. In addition, this eliminates a step for filling the inner bag with a powder, which is a necessary process when a powder is used as the core material in manufacturing the vacuum insulation material, thereby improving in production efficiency and working environment.

It is therefore possible to provide insulation box unit 102 with enhanced production efficiency and a long-time reliability, in spite of an extended use of the vacuum insulation material with an increased coverage. As a result, refrigerator 101 can contribute to energy saving over the long term.

Although the structure of the embodiment employs vacuum insulation material 108 with a thermal conductivity of 0.0015 W/m·K in the use of rigid urethane foam 108 with a thermal conductivity of 0.015 W/m·K, it is not limited thereto; inorganic fiber aggregate 116 having different fiber diameter can be employed so that the thermal conductivity of the insulation material ranges from 0.0010 W/m·K to 0.0030 W/m·K (at the ratio of 1:15 to 1:5).

The ratio above allows the rigid urethane foam not to lose flow performance within a layer, thereby maintaining preferable insulation efficiency as a multi-layered insulation section despite of having a small layer thickness. It is thus possible to provide an insulation box unit in which the vacuum insulation material is extensively used in the box unit. The structure satisfies a demand that the vacuum insulation material should be disposed even in a section having a relatively small wall thickness, achieving the energy-saving effect as expected.

Sixth Exemplary Embodiment

An insulation box unit of the sixth embodiment and a refrigerator having the insulation box unit will be described, referencing to FIG. 7. The explanation below will be given on a structure that differs from that of the fifth embodiment.

Figure 7:
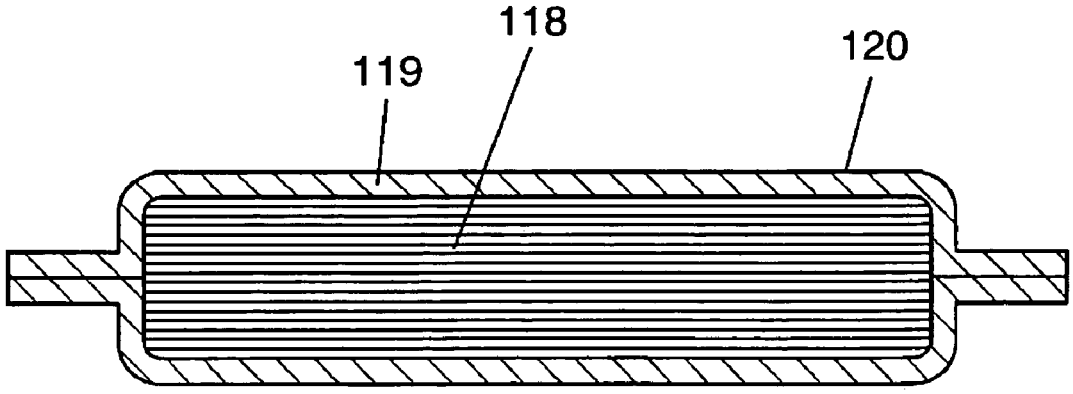
FIG. 7 is a cross-sectional view of vacuum insulation material employed for a refrigerator of the sixth embodiment.

Vacuum insulation material 120 in FIG. 7 employs sheet-type inorganic fiber aggregate 118 including glass wool. In the embodiment, a lamination of a 5-mm thick sheet-type aggregate 118 is inserted into gas-barrier covering material 119 and sealed under vacuum.

Such a thin sheet-type core material can easily adjust to desired thickness by being stacked up one on another—for example, three-layered, or five-layered as required, whereby differently shaped vacuum insulation material can be produced. The vacuum insulation material structured above can enhance the insulation efficiency of the multiple insulation layers without hampering the flow performance of rigid urethane foam 107.

Besides, the flexibility allows vacuum insulation material 120 to conform to the shape of the insulation box unit, thereby facilitating the coverage of the insulation material with respect to the surface area of outer box 105.

A poor bonding of the insulation material and the outer box can create a gap therebetween. The forming agent for expansion of rigid urethane foam often agglomerates in the gap, expanding or shrinking in response to changes in surrounding temperature, which has often resulted in deformation of the surface of the outer box 105. In contrast, the aforementioned sheet-type structure, by virtue of excellent conformability, can address the problem.

According to the structure, as described above, an infinite number of pattern variations can be easily created from one core material. Furthermore, the multi-layered structure of the core material improves evacuation ratio in sealing under vacuum. This contributes to an improved productivity and cost-reduced manufacturing.

An adhesive may be used for bonding each layer of the core material; however, in terms of minimizing the generation of gas, and of reducing the manufacturing costs and steps, a "stacked-without-adhesives" structure is preferable.

Seventh Exemplary Embodiment

An insulation box unit of the seventh embodiment and a refrigerator having the insulation box unit will be described, referring to FIGS. 8 and 9. The explanation below will be given on a structure that differs from that of the fifth embodiment.

Figure 8:
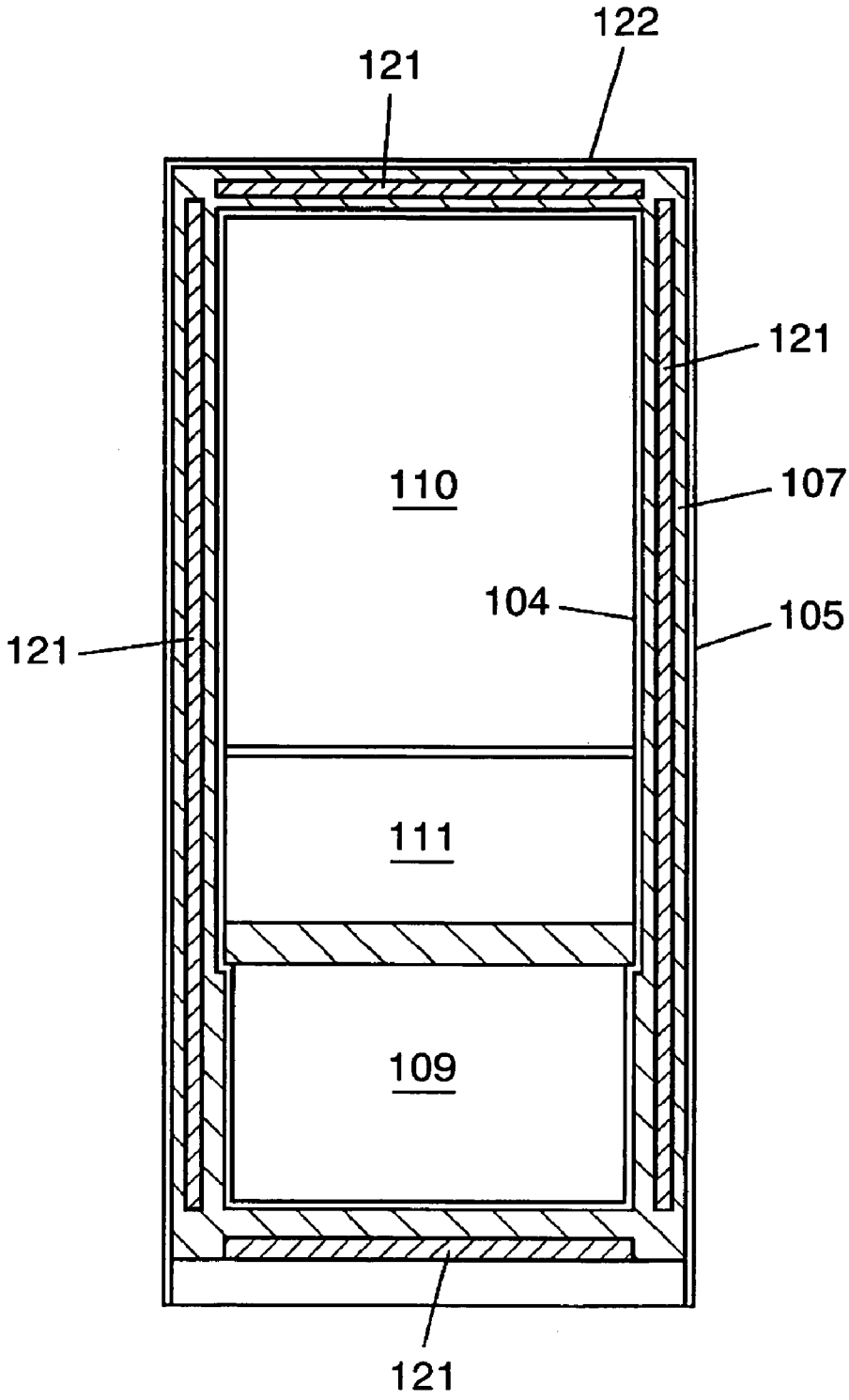
FIG. 8 shows a cross-sectional view seen from the front side of a refrigerator of a seventh embodiment.
Figure 9:
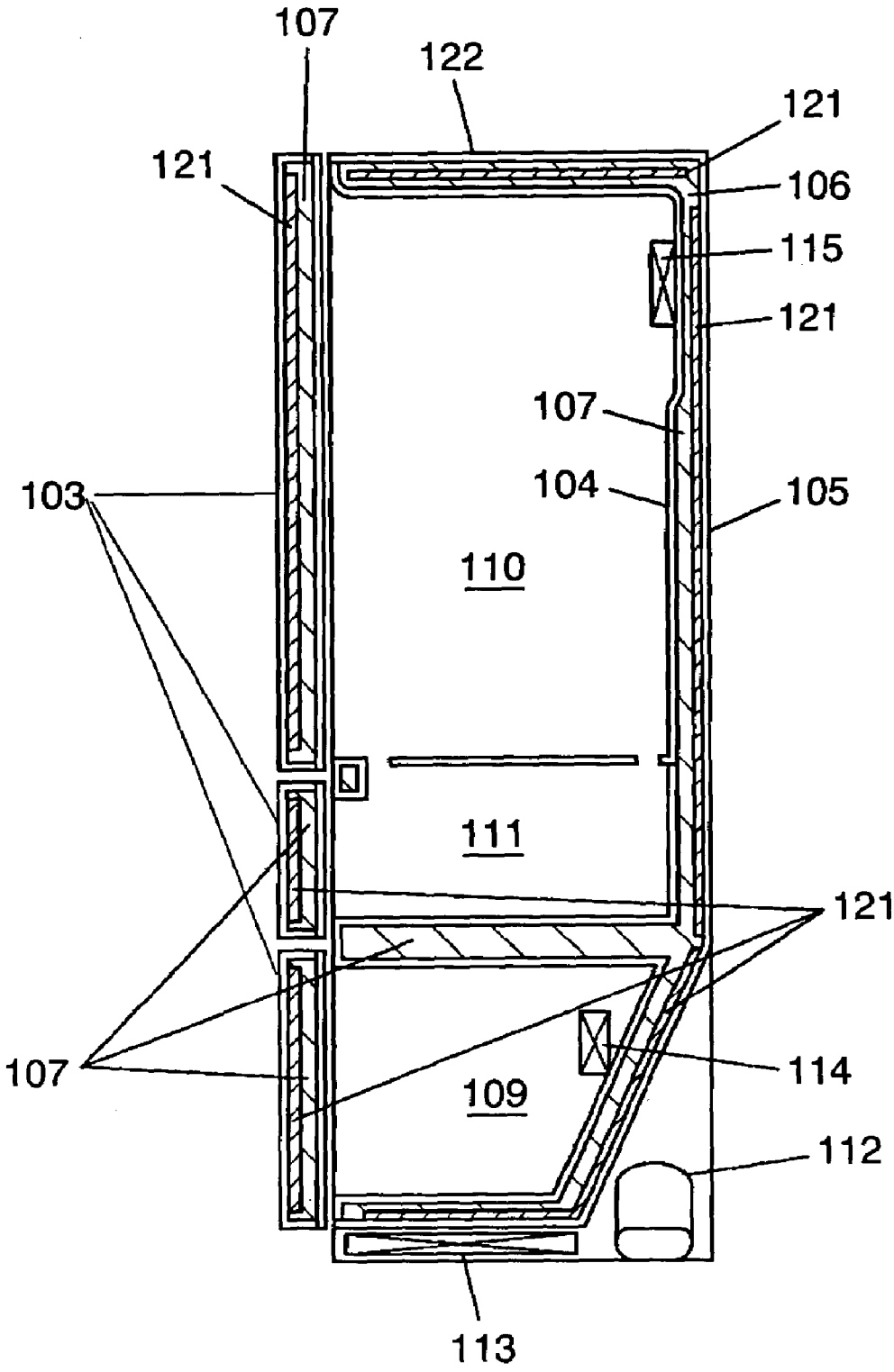
FIG. 9 shows a cross-sectional view seen from the side of the refrigerator of the seventh embodiment.

In FIGS. 8 and 9, vacuum insulation material 121 is embedded in the middle of the layer of rigid urethane foam 107. Like the structure in the fifth embodiment, the insulation material used on doors 103 and on the rear surface of insulation box unit 122 is directly attached to outer box 105.

In the aforementioned structure, the outer surfaces of vacuum insulation material 121 have an intimate contact with rigid urethane foam 107. Therefore, compared to the structure in which the vacuum insulation material has a direct contact with outer box 105 or inner box 104, the embedded structure above prevents insulation box unit 122 from decrease in strength caused by peeling-off of the insulation material.

Besides, compared to the structure in which vacuum insulation material 121 is attached to outer box 105, the embedded structure allows a conductive heat transfer projected area between the outside and the inside of the insulation box unit to be effectively covered at a position embedded in the urethane foam. Therefore, the embedded structure can increase practical coverage area.

On the side planes of insulation box unit 122, vacuum insulation material 121 has no direct contact with the surface of outer box 105. On the other hand, in a "direct contact" structure, a foaming agent of rigid urethane foam agglomerated in a gap between the outer box and the vacuum insulation material may expand or contract in response to changes in surrounding temperature, which may result in deformation of the outer box. In contrast, the aforementioned structure of the present invention, since it is free from the problems above, can prevent the insulation box unit from having a poor side-appearance as a structural defect, thereby maintaining excellent quality as a product.

In doors 103, and the rear and the back planes of insulation box unit 122, the insulation material is directly attached to the surfaces. This is because, for doors 103, the embedded structure often provides the area close to a door surface with a poor falling of the urethane foam. For the rear and back planes of insulation box unit 122, the embedded structure may complicate the design of piping for the refrigeration system, and the drain hoses for cooling devices 114 and 115; and also because that the rear and back planes are assembled integral with the vacuum insulation material for convenience in the manufacturing processes. Considering the aforementioned advantages, the embedded structure of the vacuum insulation material 121 may be employed in insulation box unit 122, where possible.

INDUSTRIAL APPLICABILITY

The insulation box unit of the present invention is formed of i) rigid urethane foam with a bending modulus of not-less-than 8.0 MPa and a density of not more than 60 kg/m$^3$, and ii) vacuum insulation material. The high bending modulus of the rigid urethane foam provides the insulation box unit with a substantial strength. Therefore, even in the case that the coverage of the vacuum insulation material (with respect to the surface of the outer box) exceeds 50%, the box unit is free from deformations caused by weight of goods accommodated therein. At the same time, the proper density (less-than-60 kg/m$^3$) can suppress the increase in thermal conductivity in solid, thereby maintain proper insulation efficiency. Such an insulation box unit has no problem in its quality, despite of an extended use of the vacuum insulation material, providing an excellent insulation efficiency and therefore contributing to energy saving.

According to the recycling method of the present invention, rigid urethane foam formed of tolylene di-isocyanate compound, which serves as an insulator in a refrigerator to be recycled, is now recycled as the raw material of rigid urethane foam; to be more specific, crude products, which are obtained through a process using supercritical or subcritical water, are fractionated to obtain tolylene diamine, and tolylene di-isocyanate compounds and tolylene diamine polyether polyol are synthesized from the tolylene diamine. In this way, the two materials for synthesizing rigid urethane foam are obtained as a result of the recycling method of the present invention.

The refrigerator of the present invention contains an insulation box unit, a refrigerating compartment formed within the insulation box unit, and refrigerating device for cooling the compartment. Employing the insulation box unit having high coverage of the vacuum insulation material with respect to the surface area of the outer box can effectively contribute to energy saving. At the same time, the structure an enhanced volumetric efficiency of internal space even though its space-saving compact body can provide an environmental friendly refrigerator.

The invention claimed is:

1. An insulation box unit comprising:

an inner box;

an outer box accommodating the inner box therein; and an insulation layer disposed between the inner box and the outer box, the insulation layer comprising:

a vacuum insulation material; and a rigid urethane foam that has a bending modulus of at least 8.0 MPa, and has a density of at most 60 kg/m$^3$, and a coverage of the vacuum insulation material with respect to a surface area of the outer box is not less than 40% and not more than 80%, wherein the rigid urethane foam covers substantially a whole surface of the inner box.

2. The insulation box unit of claim 1, wherein the vacuum insulation material is disposed on all planes—a top, a rear, a front, a bottom, and both sides—of the insulation box unit.

3. The insulation box unit of claim 2, wherein the insulation box unit has a door, and a thickness of the insulation layer disposed on the planes, except for the door, of the insulation box unit is in a range from 20 mm to 50 mm.

4. The insulation box unit of claim 3, wherein the thickness of the insulation layer surrounding a freezing-temperature zone, except for the door, is in a range from 20 mm to 50 mm.

5. The insulation box unit of claim 3, wherein the thickness of the insulation layer surrounding a refrigerating-temperature zone, except for the door, is in a range from 20 mm to 40 mm.

6. The insulation box unit in accordance with claim 1, wherein a thickness of the vacuum insulation material is in a range from 10 mm to 20 mm.

7. The insulation box unit of claim 1, wherein the insulation box unit has at least three doors.

8. The insulation box unit of claim 1, wherein the rigid urethane foam is a reaction product generated by blending a) an isocyanate component including tolylene diisocyanate compounds with b) a pre-mix component including polyol, a foam stabilizer, a catalyst, and a foaming agent.

9. The insulation box unit of claim 8, wherein the rigid urethane foam is produced by using water as a foaming agent.

10. The insulation box unit of claim 1, wherein the vacuum insulation material contains an inorganic fiber aggregate and a gas-barrier film that covers the inorganic fiber aggregate.

11. The insulation box unit of claim 10, wherein the aggregate is a multi-layered sheet-type inorganic fiber.

12. The insulation box unit of claim 1, wherein thermal conductivity of the rigid urethane foam is at least five times and at most fifteen times of thermal conductivity of the vacuum insulation material.

13. The insulation box unit of claim 1, wherein the rigid urethane foam is disposed on both surfaces of the vacuum insulation material of the insulation layer.

14. The insulation box unit of claim 1, wherein the insulation layer on a side of the insulation box unit includes the insulation layer having the rigid urethane foam on both surfaces of the vacuum insulation material.

15. The insulation box unit in accordance with claim 2, wherein a thickness of the vacuum insulation material is in a range from 10 mm to 20 mm.

16. The insulation box unit in accordance with claim 3, wherein the thickness of the vacuum insulation material is in a range from 10 mm to 20 mm.

17. The insulation box unit in accordance with claim 4, wherein the thickness of the vacuum insulation material is in a range from 10 mm to 20 mm.

18. The insulation box unit in accordance with claim 5, wherein the thickness of the vacuum insulation material is in a range from 10 mm to 20 mm.

19. The insulation box unit in accordance with claim 15 wherein the rigid urethane foam is a reaction product generated by blending a) an isocyanate component including tolylene diisocyanate compounds with b) a pre-mix component including a polyol, a foam stabilizer, a catalyst, and a foaming agent, and wherein the polyol contains tolylene diamine polyether polyol and the foaming agent is water.

20. The insulation box unit in accordance with claim 8, wherein the polyol contains tolylene diamine polyether polyol.

21. The insulation box unit in accordance with claim 1, wherein the rigid urethane foam is a closed-cell urethane foam.

22. A refrigerator comprising:

a) an insulation box unit comprising:

an inner box;

an outer box accommodating the inner box therein; and an insulation layer disposed between the inner box and the outer box, the insulation layer comprising:

a vacuum insulation material; and a rigid urethane foam that has a bending modulus of at least 8.0 MPa, and has a density of at most 60 kg/m3, and a coverage of the vacuum insulation material with respect to a surface area of the outer box is not less than 40% and not more than 80%, wherein the rigid urethane foam covers substantially a whole surface of the inner box; and b) at least one cooling box formed in the insulation box unit; and c) a cooling device.

23. The refrigerator of claim 22, wherein the refrigerator has, on a surface, a tag on which a material type of the rigid urethane foam is recorded.

24. The refrigerator in accordance with claim 22, wherein the rigid urethane foam is a closed-cell urethane foam.

* * * * *